United States Patent [19]

Claxton

[11] Patent Number: 4,863,285

[45] Date of Patent: Sep. 5, 1989

[54] MANUFACTURE OF BAGS

[76] Inventor: Nigel E. Claxton, High Tree Lodge, Challock, nr Ashford, Kent, England

[21] Appl. No.: 192,861

[22] Filed: May 11, 1988

[30] Foreign Application Priority Data

May 11, 1987 [ZA] South Africa ..... 87/3322
Feb. 29, 1988 [ZA] South Africa ..... 88/1429

[51] Int. Cl.[4] ..... B65D 33/16
[52] U.S. Cl. ..... 383/37; 383/63
[58] Field of Search ..... 383/37, 63, 65; 229/69

[56] References Cited

U.S. PATENT DOCUMENTS

| | | | |
|---|---|---|---|
| 2,723,076 | 11/1955 | Whitman | 229/69 |
| 3,469,769 | 9/1969 | Guenther | 229/69 |
| 3,559,874 | 2/1971 | Titchenal . | |
| 3,866,822 | 2/1975 | Faltin et al. . | |
| 4,508,224 | 4/1985 | Weber et al. | 229/69 |
| 4,630,311 | 12/1986 | Bentson | 383/37 |
| 4,637,060 | 1/1987 | Ausnit | 383/37 |
| 4,665,552 | 5/1987 | Lems et al. | 383/37 |

FOREIGN PATENT DOCUMENTS

| | | |
|---|---|---|
| WO87/02968 | 5/1987 | PCT Int'l Appl. . |
| 751339 | 6/1956 | United Kingdom . |
| 991639 | 5/1969 | United Kingdom . |
| 1517856 | 7/1978 | United Kingdom . |
| 1600632 | 10/1981 | United Kingdom . |
| 2109771 | 6/1983 | United Kingdom . |
| 2117351 | 10/1983 | United Kingdom . |

*Primary Examiner*—Stephen P. Garbe
*Attorney, Agent, or Firm*—Curtis, Morris & Safford

[57] ABSTRACT

A web comprising two end-to-end series of bags of synthetic plastics material is disclosed. The bags of each series are joined to one another by structures comprising weld lines and lines of weakening. The two series are joined to one another by a structure comprising either a line of weakening or a line of weakening with welds on each side thereof. The web is constituted by a tube which is extruded with two sets of inter-engagable ribs. Each series of bags is punched with a row of tractor holes. In another form there is a single end-to-end series of bags.

6 Claims, 3 Drawing Sheets

MANUFACTURE OF BAGS

This invention relates to the manufacture of bags of sheet synthetic plastics material.

According to the present invention there is provided a web comprising an end-to-end series of bags of synthetic plastic material, each bag being joined to an adjacent bag along a structure comprising a line of weakening and a weld on each side of the line of weakening, said welds forming edges of the bags and the web further having two laterally spaced rows of tractor holes and at least one set of inter-engagable ribs, the rows and ribs both extending in the direction of the length of the web and extending parallel to one another with the ribs adjacent one edge of the web.

In one form said web includes a single set of inter-engageable ribs which are adjacent one edge of the web, a first row of tractor holes between said one edge of the web and the ribs, and a second row of tractor holes adjacent the other edge of the web.

In another form the web is slit along said one edge.

Where relatively small bags are being produced, the web can include two parallel series of bags joined to one another along a line of weakening which extends along the centre of the web, there being a set of ribs adjacent each edge of the web and a row of tractor holes between each set of ribs and the adjacent edge of the web.

The tractor holes can be punched in the bags. In an alternative form the web includes two paper strips adhered to the series of bags along edge zones of series of bags and which protrude outwardly therefrom, said rows of tractor holes being punched in the paper strips.

For a better understanding of the present invention, and to show how the same may be carried into effect, reference will now be made, by way of example, to the accompanying drawings in which.

Figure 1:
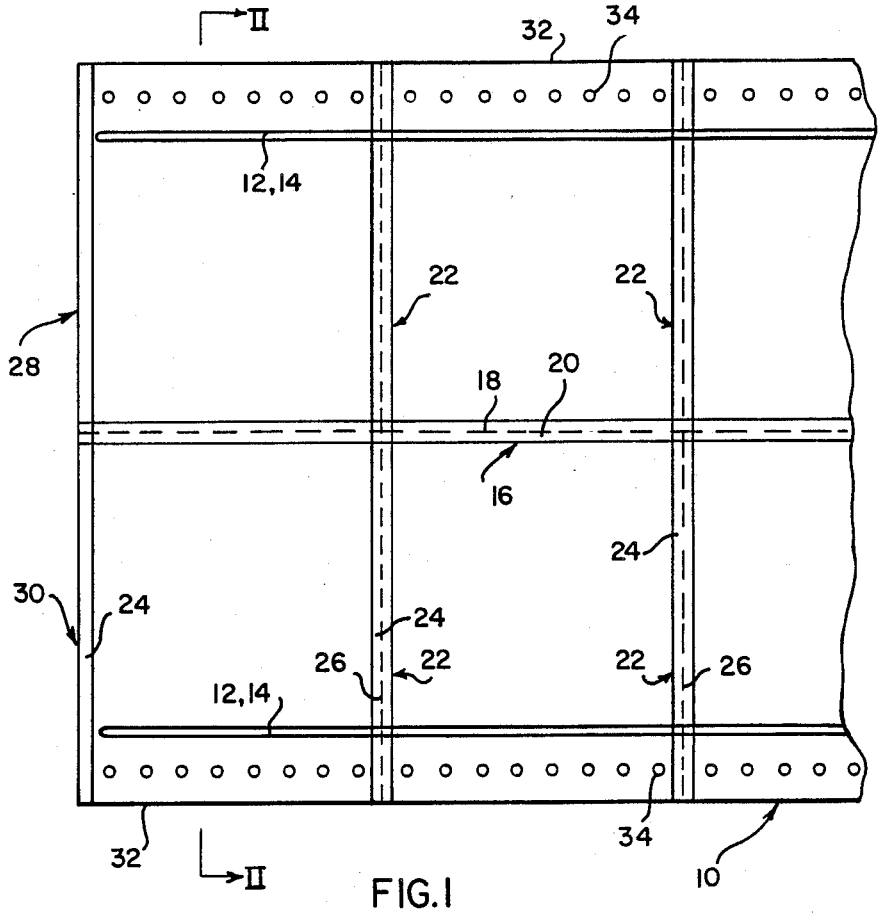
FIG. 1 is a plan view of part of a web comprising two series of bags.
Figure 5:
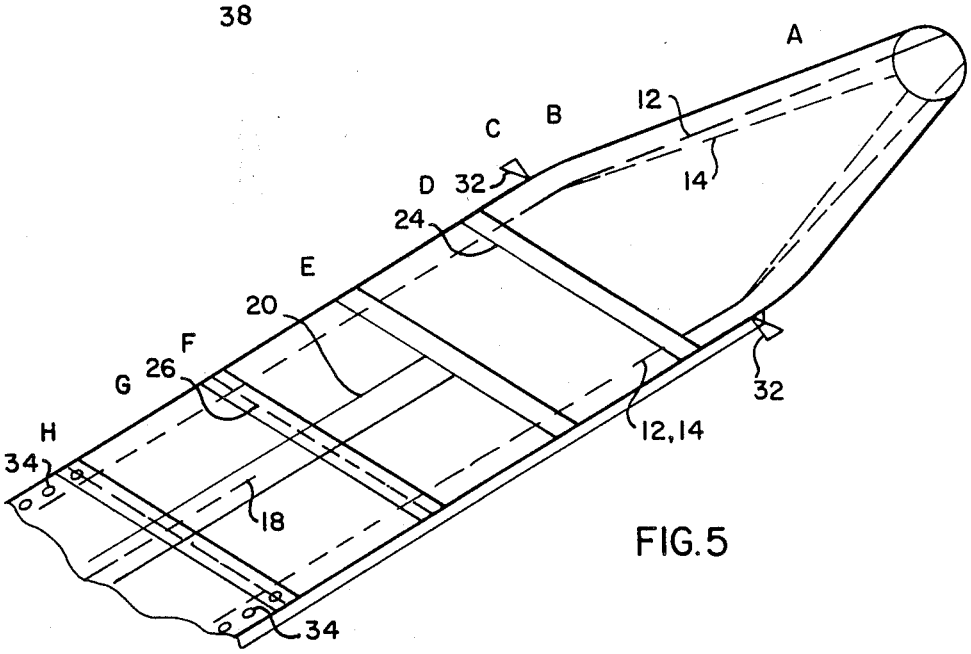
Figure 6:
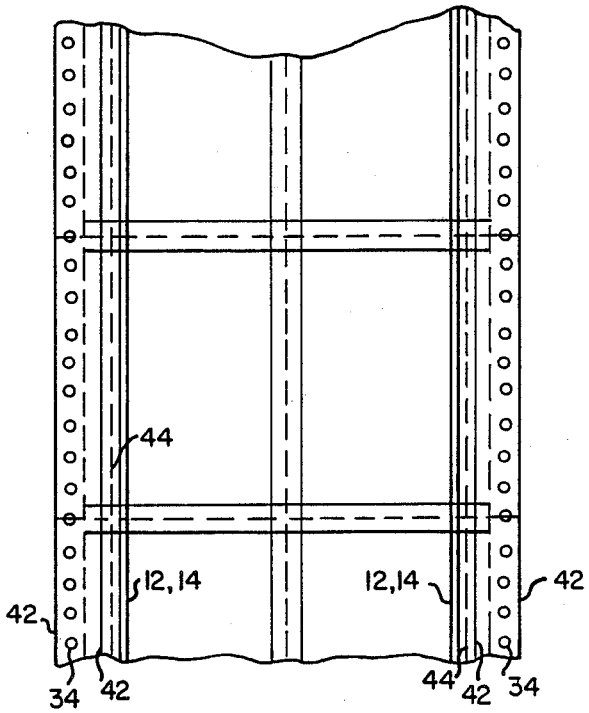

FIG. 5 diagrammatically illustrates the way in which the web of FIG. 1 is produced;

FIG. 6 illustrates a further web; and

Figure 7:
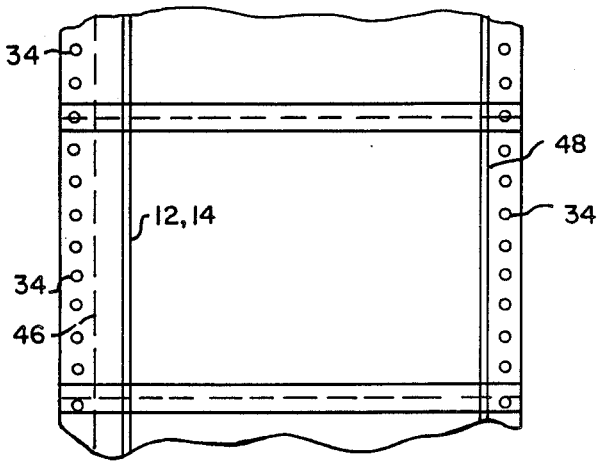

FIG. 7 illustrates yet another web.

Figure 2:
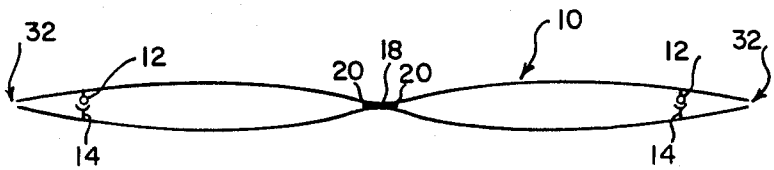
FIG. 2 is a section on the line II—II of FIG. 1 with the superposed layers of the web slightly separated.

Referring firstly to FIGS. 1 and 2, the web 10 illustrated comprises an extruded tube of synthetic plastics material. The tube is extruded with four longitudinally extending ribs on the inner face of the tube, the ribs being in sets. Each set of ribs comprises a male rib 12 and a female rib 14. The tube is formed with a longitudinally extending central structure designated 16 and which comprises a line of weakening 18 which extends centrally along a weld line 20.

At regular intervals along the length of the web there are transverse structures 22 each comprising a weld line 24 with a line of weakening 26 along the centre of the weld line 24. The lines of weakening can be formed by perforating the web. Thus the web comprises two series of bags which have been designated 28 and 30, the structures 22 bounding individual bags of each series and the structure 16 forming the boundary between the two series.

If desired each structure 16 and 22 can comprise two parallel weld lines with a line of weakening between the weld lines.

The tube 10 is slit at the two locations designated 32. It will be noted that these locations are where the tube 10 is folded back on itself and lie outwardly of the sets of ribs 12, 14. Between each location 32 and the adjacent set of ribs 12, 14 there is punched a row of tractor holes 34.

Once a bag has been detached from the web by tearing along the lines 18, 26, access can be had to the interior of the bag by separating the ribs 12 and 14 from one another whereupon the slit at 32 forms the mouth of the bag. The weld lines 20 and 24 respectively form the base and side edges of the bag.

Figure 4:
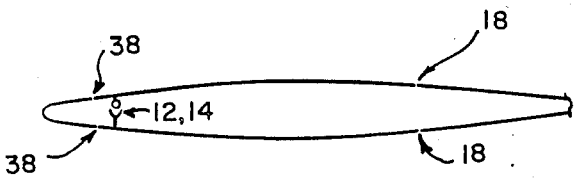
FIG. 4 is a section on the line III—III of FIG. 3.
Figure 3:
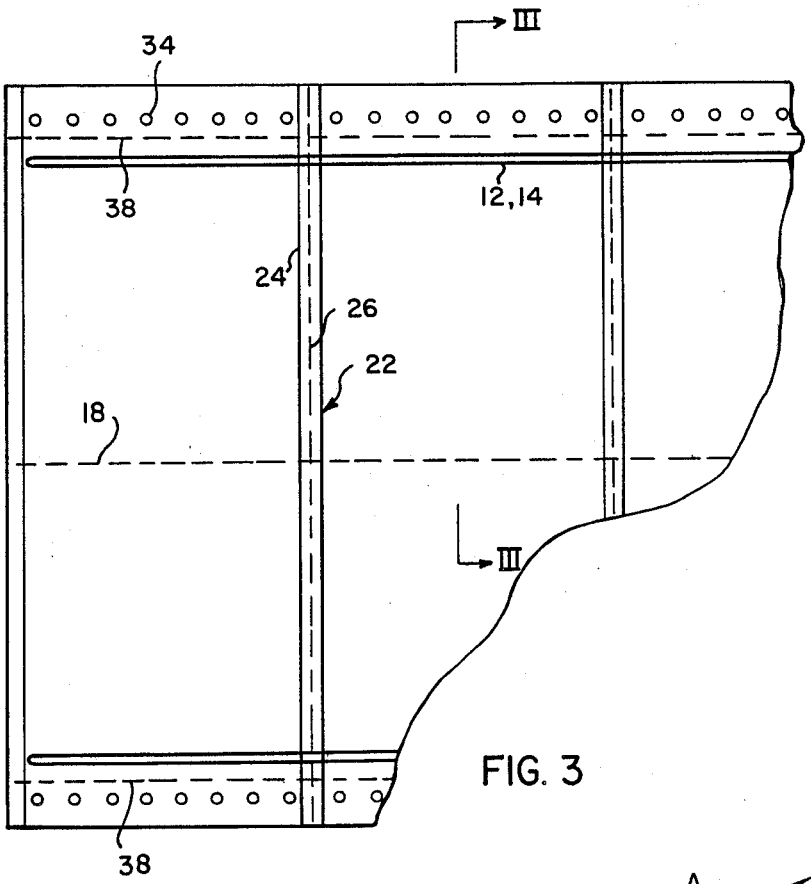
FIG. 3 is a plan view of part of a further web comprising two series of bags.

Turning now to FIGS. 3 and 4, the web illustrated differs from that shown in FIG. 1 in that it is not slit at the two locations 32. Two additional lines of weakening 38 are provided. The lines of weakening 38 are parallel to the line of weakening 18 and are shown in FIG. 3 as being between the sets of ribs 12, 14 and the rows of tractor holes 34. The lines of weakening 38 can, however, be between the folded edges of the tube and the rows of tractor holes 34, or can co-incide with the rows of tractor holes 34. A further difference between the two webs is that the two series of bags are, in FIG. 3, separated by a line of weakening 18 only, the weld line 20 of FIG. 1 being omitted.

When a bag is detached from the web of FIG. 3 it is closed where the extruded tube is folded and open along the opposed edge, that is, along the edge defined by the line of weakening 18. The bag is filled through the mouth which is remote from the folded edge of the tube. Once the bag has been filled a weld line is formed which is bounded on one side by the uneven edge which was constituted by the line of weakening 18 thereby to create the bottom of the bag and close the bag. Access is thereafter had to the bag by tearing along the line of weakening 38 and separating the ribs 12, 14. The fact that the bag has been torn along the line of weakening 38 provides a tamper evident feature.

Turning now to FIG. 5, this diagrammatically illustrates the production of the web of FIG. 1. Production is carried out in seven stages (designated A to H) on a web which is running at constant speed through zones A to C and step-wise through zones D to H. The transition from constant speed movement to step-wise movement is achieved by passing the web under a dancer roller which rises and falls to take-up the slack which results from constant rate extrusion and intermittant feed into zones D etc. The web advances through zones D etc at increments equal to the distance between the lines of weakening 26. The following are the operations which take place at each zone:

Zone A. The tubing from which the web is produced is progressively collapsed to flat form with two folds forming the edges thereof.

Zone B. The sets of ribs 12, 14 are engaged.

Zone C. The tube is slit at locations 32.

Zone D. The transverse weld lines 24 are formed.

Zone E. The longitudinal weld line 20 is formed.

Zone F. The lines of weakening 26 are formed along the transverse welds 24.

Zone G. The line of weakening 18 is formed along the weld line 20.

Zone H. The rows of tractor drive holes 34 are punched in the web outwardly of the pairs of ribs 12, 14.

The zones are not necessarily arranged in this order. For example, zone E may be ahead of zone D and zone G may be ahead of zone F.

The web of FIG. 3 is produced in a substantially similar manner. The steps of Zone C and Zone E are, however, omitted and there is a zone which is either ahead of or downstream of the Zone H at which the lines of weakening 38 are introduced.

Formation of the weld lines 24 results in the ribs 12, 14 being flattened.

The web of FIG. 6 is shown as being of the general form illustrated in FIG. 1 but could be of the general form illustrated in FIG. 3.

The web of FIG. 6 does not have rows of tractor holes punched in the bags themselves. Instead, the web comprises the series of bags and two paper strips 42 which are adhered to longitudinally extending edge zones of the series of bags, the rows of tractor holes 34 being punched in the paper strips. When the paper strips are incorporated in a series of bags of the form illustrated in FIG. 1 then it is desirable that lines of weakening 44 be introduced between the edge zones along which the paper strips are adhered to the bags and the ribs 12, 14. Thus by tearing along these lines of weakening, the paper strips and edge zones can be detached. It is also desirable for the paper strips to be adhered to the series of bags prior to Zone F being reached. Thus the paper strips are themselves perforated and weakened transversely so that they readily tear when bags are being removed. In a series of bags of the general type shown in FIG. 3, the paper strips are adhered outwardly of the lines of weakening 38. Thus the paper strips are removed when the bags are opened.

Turning now to FIG. 7, this illustrates a web which comprises a single series of bags and which consists of an extruded and flattened tube which has only one set of inter-engageable ribs 12, 14. Between the set of ribs 12, 14 and the adjacent edge of the web there is a line of weakening designated 46. The row of tractor holes at that side of the web lies between the edge of the web and the line of weakening 46.

Adjacent the other edge of the web there is a longitudinally extending weld 48. The other row of tractor holes is between the weld 48 and the other edge of the web. Once an individual bag has been torn from the web of FIG. 7 it can be opened by removing an edge zone by tearing along the line of weakening 46. If desired the weld 48 can be formed after the bag has been filled. If this procedure is followed then, to open the bag, the edge zone outwardly of the line of weakening 46 must be removed and this provides a tamper evident feature. In a modified form the web is split along the fold which lies adjacent the ribs 12, 14 and the line of weakening 46 is omitted. The bag can then be opened and closed using the ribs 12, 14 but the tamper evident feature is then lost. Furthermore the two rows of tractor holes remain part of the bag. In a further modification a line of weakening can be provided between the weld 48 and the adjacent row of tractor holes 34. In this form, assuming that the line of weakening 46 is also provided, edge zones of the web can be removed entirely whereby the final bag is devoid of any tractor holes.

It will be understood that a web of the form shown in FIG. 7 can, instead of having the tractor holes punched in the bags themselves, include paper strips as illustrated in FIG. 6.

If desired a printing step may be introduced while the web is being manufactured, the printing step preferably being the last step so that the rows of tractor holes may be used to register the web with the printer.

I claim:

1. A web comprising two parallel end-to-end series of bags of synthetic plastic material, the parallel series of bags being joined to one another along a line of weakening which extends along the centre of the web, each bag being joined to an adjacent bag of its series along a structure comprising a line of weakening and a weld on each side of the line of weakening, said welds forming edges of the bags and the web further having two laterally spaced rows of tractor holes and two sets of inter-engageable ribs, there being a set of ribs adjacent each edge of the web, the rows and ribs both extending in the direction of the length of the web and extending parallel to one another with the rows of tractor holes between each set of ribs and the adjacent edge of the web.

2. A web as claimed in claim 1, wherein said rows of tractor holes are punched in said bags.

3. A web as claimed in claim 2, and including a line of weakening extending in the direction of the length of the web between each row of tractor holes and each pair of ribs.

4. A web as claimed in claim 3 and including lines of weakening which extend in the direction of the length of the web and coincide with said rows of tractor holes.

5. A web as claimed in any one of claims 2 to 4, wherein the two series of bags are joined to one another by a structure which includes a longitudinally extending weld, the longitudinally extending weld extending on each side of said line of weakening which extends along the centre of the web.

6. A web comprising an end-to-end series of bags of synthetic plastic material, each bag being joined to an adjacent bag along a structure comprising a line of weakening and a weld on each side of the line of weakening, said welds forming edges of the bags and the web further having first and second laterally spaced rows of tractor holes and a single set of inter-engageable ribs which ribs are adjacent one edge of the web, said first row of said tractor holes being between said one edge of the web and the ribs, and said second row of said tractor holes being adjacent the other edge of the web, the rows and ribs both extending in the direction of the length of the web and extending parallel to one another with the ribs adjacent one edge of the web, there being a longitudinally extending weld adjacent the other edge of the web, said second row of tractor holes being between this weld and said other edge of the web, and the web being split along said one edge.

* * * * *